US011905968B2

(12) United States Patent
Yoshihara et al.

(10) Patent No.: US 11,905,968 B2
(45) Date of Patent: Feb. 20, 2024

(54) VACUUM PUMP, CASING, AND INLET PORT FLANGE

(71) Applicant: Edwards Japan Limited, Chiba (JP)

(72) Inventors: Nahoko Yoshihara, Chiba (JP); Yoshiyuki Sakaguchi, Chiba (JP); Yohei Ogawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 69 days.

(21) Appl. No.: 17/439,650

(22) PCT Filed: Mar. 13, 2020

(86) PCT No.: PCT/JP2020/011071
§ 371 (c)(1),
(2) Date: Sep. 15, 2021

(87) PCT Pub. No.: WO2020/195942
PCT Pub. Date: Oct. 1, 2020

(65) Prior Publication Data

US 2022/0186743 A1 Jun. 16, 2022

(30) Foreign Application Priority Data

Mar. 26, 2019 (JP) ..... 2019-058715
Sep. 20, 2019 (JP) ..... 2019-171350

(51) Int. Cl.
*F04D 19/04* (2006.01)
*F04D 29/42* (2006.01)

(52) U.S. Cl.
CPC ..... *F04D 29/4206* (2013.01); *F04D 19/04* (2013.01)

(58) Field of Classification Search
CPC .... F04D 29/4206; F04D 19/04; F04D 19/042; F04D 23/008; F04D 29/522; F04D 29/644; F05D 2250/50; F05D 2250/51
See application file for complete search history.

(56) References Cited

U.S. PATENT DOCUMENTS 7,495,173 B2 * 2/2009 Jung ..... F16L 23/20 174/91
7,993,113 B2 * 8/2011 Namiki ..... F04D 29/601 417/423.4

(Continued)

FOREIGN PATENT DOCUMENTS

JP S6028298 2/1985
JP 2003003988 A 1/2003

(Continued)

OTHER PUBLICATIONS

PCT International Search Report dated Jun. 2, 2020 for corresponding PCT application Serial No. PCT/JP2020/011071, 3 pages.

(Continued)

*Primary Examiner* — David E Sosnowski
*Assistant Examiner* — Arthur Paul Golik
(74) *Attorney, Agent, or Firm* — Theodore M. Magee; Westman, Champlin & Koehler, P.A.

(57) ABSTRACT

To provide a vacuum pump which separates and constructs an inlet port flange and a casing (outer cylinder) as two components to reduce weight while retaining required strength and which is consequently capable of reducing manufacturing cost. In a vacuum pump, an inlet port flange and a casing (outer cylinder) are separated from each other and constructed as different members. The inlet port flange uses stainless steel as a material thereof and the casing (outer cylinder) use aluminum as a material thereof. The components are fastened to each other by bolts and sealed by an O-ring in order to maintain a vacuum property during assembly of the vacuum pump. Accordingly, a weight of the vacuum pump can be reduced while maintaining strength of the inlet port flange.

5 Claims, 7 Drawing Sheets

(56) References Cited

U.S. PATENT DOCUMENTS

| | | | | |
|---|---|---|---|---|
| 2003/0007862 | A1* | 1/2003 | Ohtachi | F04D 29/701 415/121.2 |
| 2009/0081056 | A1 | 3/2009 | Maejima et al. | |

FOREIGN PATENT DOCUMENTS

| | | | | | |
|---|---|---|---|---|---|
| JP | 2006037951 | A | | 2/2006 | |
| JP | 2008075489 | A | | 4/2008 | |
| JP | 2015059426 | A | | 3/2015 | |
| JP | 2017014945 | A | * | 1/2017 | F04D 19/04 |
| JP | 2017190744 | A | | 10/2017 | |
| WO | 2006068014 | A1 | | 6/2006 | |
| WO | 2008035497 | A1 | | 3/2008 | |
| WO | WO-2008035497 | A1 | * | 3/2008 | F04D 19/042 |

OTHER PUBLICATIONS

PCT International Written Opinion dated Jun. 2, 2020 for corresponding PCT application Serial No. PCT/JP2020/011071, 4 pages.
European communication dated Nov. 22, 2022 and Supplementary European Search Report dated Nov. 10, 2022 for corresponding European application Serial No. EP20778192.

* cited by examiner

VACUUM PUMP, CASING, AND INLET PORT FLANGE

CROSS-REFERENCE OF RELATED APPLICATION

This application is a Section 371 National Stage Application of International Application No. PCT/JP2020/011071, filed Mar. 13, 2020, which is incorporated by reference in its entirety and published as WO 2020/195942A1 on Oct. 1, 2020 and which claims priority of Japanese Application No. 2019-058715, filed Mar. 26, 2019 and Japanese Application No. 2019-171350, filed Sep. 20, 2019.

BACKGROUND

The present invention relates to a vacuum pump in which an outer cylinder and a flange that are components of the vacuum pump are separately constructed of different materials, a casing, and an inlet port flange.

Molecular pumps (vacuum pumps) such as turbo-molecular pumps and thread groove pumps are often used to exhaust semiconductor manufacturing apparatuses and used as vacuum containers of electron microscopes or the like which require a high vacuum.

Such vacuum pumps are usually provided with a flange of a predetermined size and are configured to be fixed by bolts or the like to an outlet port-side flange (hereinafter, referred to as an apparatus-side flange) of a vacuum apparatus (hereinafter, referred to as an apparatus) that requires exhaust.

High airtightness is maintained between the flange of the vacuum pump (hereinafter, the flange of the vacuum pump will be referred to as an inlet port flange) and the apparatus-side flange by fixing the inlet port flange and the apparatus-side flange to each other while sandwiching an O-ring therebetween.

The vacuum pump is provided with a rotor which is rotatably supported and which is capable of being rotated at high speed by a motor and a stator which is fixed to an inside of a casing of the vacuum pump. When the motor rotates at high speed, an exhaust action is exhibited due to an interaction between the rotor and the stator. Due to the exhaust action, gas on the apparatus side is sucked from an inlet port of the vacuum pump and exhausted through an outlet part of the vacuum pump. A high-vacuum state inside the apparatus is realized in this manner.

Usually, the vacuum pump exhausts gas in a molecular flow region (a region with a high degree of vacuum in which particles less frequently collide with each other). In order to exhibit exhaust performance in the molecular flow region, the rotor is required to rotate at a high speed of around 30,000 rotations per minute.

FIG. 7 is a diagram for describing a vacuum pump according to conventional art. As shown in the diagram, an outer side of a vacuum pump 1 is formed by a casing (outer cylinder) 2, an inlet port flange 200, and a base 3.

Among these components, the casing (outer cylinder) 2 and the inlet port flange 200 are integrally formed as a single component. There are other vacuum pumps in which both components are manufactured as separate components and subsequently integrated by welding. Stainless steel is used as the material of the components.

When using a component created by integrally forming the casing (outer cylinder) 2 and the inlet port flange 200 as a single component using stainless steel, a high material cost results in high overall cost. In addition, processing such as machining requires great care.

On the other hand, when using components that are manufactured as separate components and subsequently integrated by welding, the welding operation requires great care, and despite no longer having to perform processing such as machining, cost reduction cannot be achieved.

In addition, using stainless steel in the casing (outer cylinder) 2 increases weight and imposes a strain during installation work at an installation site.

A vacuum pump and a flange disclosed in Japanese Patent Application Laid-open No. 2008-75489 are provided with a mechanism which absorbs energy with an inlet port flange when the vacuum pump is subjected to impact. Even with the vacuum pump disclosed in Japanese Patent Application Laid-open No. 2008-75489, a casing (outer cylinder) and the inlet port flange having been integrally formed as a single component are used.

Japanese Patent Application Laid-open No. 2015-59426 discloses a technique for absorbing, with a stator component, fracture energy created when a rotor breaks while rotating in a vacuum pump. Specifically, it is described that the following condition is satisfied between an outer peripheral surface and an inner peripheral surface of a casing of the vacuum pump in a state where the stator component is housed inside the casing.

$2d/D \leq \varepsilon max$ (D: outer diameter of stator component, d: width of gap, and $\varepsilon max$: elongation at break of stator component)

Accordingly, when fracture energy is generated, since the elongated and deformed stator component either does not come into contact or only comes into slight contact with the inner peripheral surface of the casing, the fracture energy can be prevented from being transferred to the casing via the stator component.

The discussion above is merely provided for general background information and is not intended to be used as an aid in determining the scope of the claimed subject matter. The claimed subject matter is not limited to implementations that solve any or all disadvantages noted in the background.

SUMMARY

In a vacuum pump, since a rotor is rotating at high speed inside the vacuum pump, when some kind of problem occurs during an operation of the vacuum pump and the rotor collides with a stator member inside the vacuum pump, a large torque that causes the entire vacuum pump to rotate in a direction of rotation of the rotor is instantaneously generated. The torque also places heavy stress on a vacuum container via the inlet port flange. Therefore, the inlet port flange may sometimes be provided with a buffer structure for reducing the torque such as that described in Japanese Patent Application Laid-open No. 2008-75489, and since the inlet port flange is to be connected to a vacuum container, there is a need to construct the inlet port flange with a material that is as strong as possible.

On the other hand, there are demands for making the vacuum pump itself light weight in order to reduce strain during installation work on an installation site or the like.

In addition, a technique is desired for absorbing, as much as possible, fracture energy created when the rotor breaks during rotation by a casing to prevent the fracture energy from affecting the inlet port flange of the vacuum pump.

In consideration thereof, a first object of the present invention is to provide a vacuum pump which separates and constructs an inlet port flange and a casing (outer cylinder)

as two components to reduce weight while retaining required strength and which is consequently capable of reducing manufacturing cost.

In addition, a second object of the present invention is to provide a vacuum pump which, on the premise of separating and constructing an inlet port flange and a casing (outer cylinder) as two components, absorbs fracture energy with the casing as much as possible and prevents the inlet port flange of the vacuum pump from being affected.

An invention according to claim 1 provides a vacuum pump including: an inlet port flange to be coupled to an apparatus; a casing which functions as a housing for covering internal members; an outlet port; a base portion: and a rotating portion which is enclosed by and rotatably supported by the casing and the base portion, wherein the inlet port flange and the casing are formed as separate components, the casing is made of aluminum, and the inlet port flange and the casing are fastened to each other.

An invention according to claim 2 provides the vacuum pump according to claim 1, wherein the inlet port flange is made of stainless steel.

An invention according to claim 3 provides a casing used in a vacuum pump including: an inlet port flange to be coupled to an apparatus; a casing which functions as a housing for covering internal members; an outlet port; a base portion; and a rotating portion which is enclosed by and rotatably supported by the casing and the base portion, wherein the casing is formed as a separate component from the inlet port flange, the casing is made of aluminum, and the casing can be fastened to the inlet port flange.

An invention according to claim 4 provides an inlet port flange used in a vacuum pump including: an inlet port flange to be coupled to an apparatus; a casing which functions as a housing for covering internal members; an outlet port; a base portion; and a rotating portion which is enclosed by and rotatably supported by the casing and the base portion, wherein the inlet port flange s formed as a separate component from the casing, the inlet port flange is made of stainless steel, and the inlet port flange can be fastened to the casing.

An invention according to claim 5 provides the vacuum pump according to claim 1 or 2, wherein the casing is provided with a projecting portion for performing positioning when fastening the casing to the inlet port flange.

An invention according to claim provides the vacuum pump according to claim 5, wherein the projecting portion or the inlet port flange is provided with a release portion for absorbing fracture energy.

An invention according to claim 7 provides the casing according to claim 3, wherein the casing is provided with a projecting portion for performing positioning in relation the inlet port flange when fastening the casing to the inlet port flange.

An invention according to claim 8 provides the casing according to claim 7, wherein the projecting portion is provided with a release portion for absorbing fracture energy.

An invention according to claim 9 provides the inlet port flange according to claim 4, wherein an inlet port flange-side release portion for absorbing fracture energy from a projecting portion is provided at a position that comes into contact with the projecting portion of the casing when fastening the inlet port flange to the casing.

According to the present invention, a weight of a vacuum pump can be reduced while maintaining required strength and a manufacturing cost of the vacuum pump can be reduced.

In addition, according to the present invention, fracture: energy that is generated when a rotor breaks can be absorbed with a casing as much as possible and the fracture energy can be prevented from affecting the inlet port flange.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

(i) Summary of Embodiment

In a vacuum pump 1 according to an embodiment of the present invention, an inlet port flange 100 and a casing (outer cylinder) 2 are separated from each other and constructed as different members.

The inlet port flange 100 uses stainless steel as a material thereof and the casing (outer cylinder) 2 uses aluminum as a material thereof.

Both components are fastened by bolts and sealed by an O-ring in order to maintain a vacuum property during assembly of the vacuum pump 1.

Accordingly, a weight of the vacuum pump 1 can be reduced while maintaining strength of the inlet port flange 100 (for example, the buffer structure against impact described in Japanese Patent Application Laid-open No. 2008-75489 can also be provided).

(ii) Details of Embodiment

Hereinafter, a preferred embodiment of the present invention will be described in detail with reference to FIGS. 1 and 2.

Configuration of Vacuum Pump 1

Figure 1:
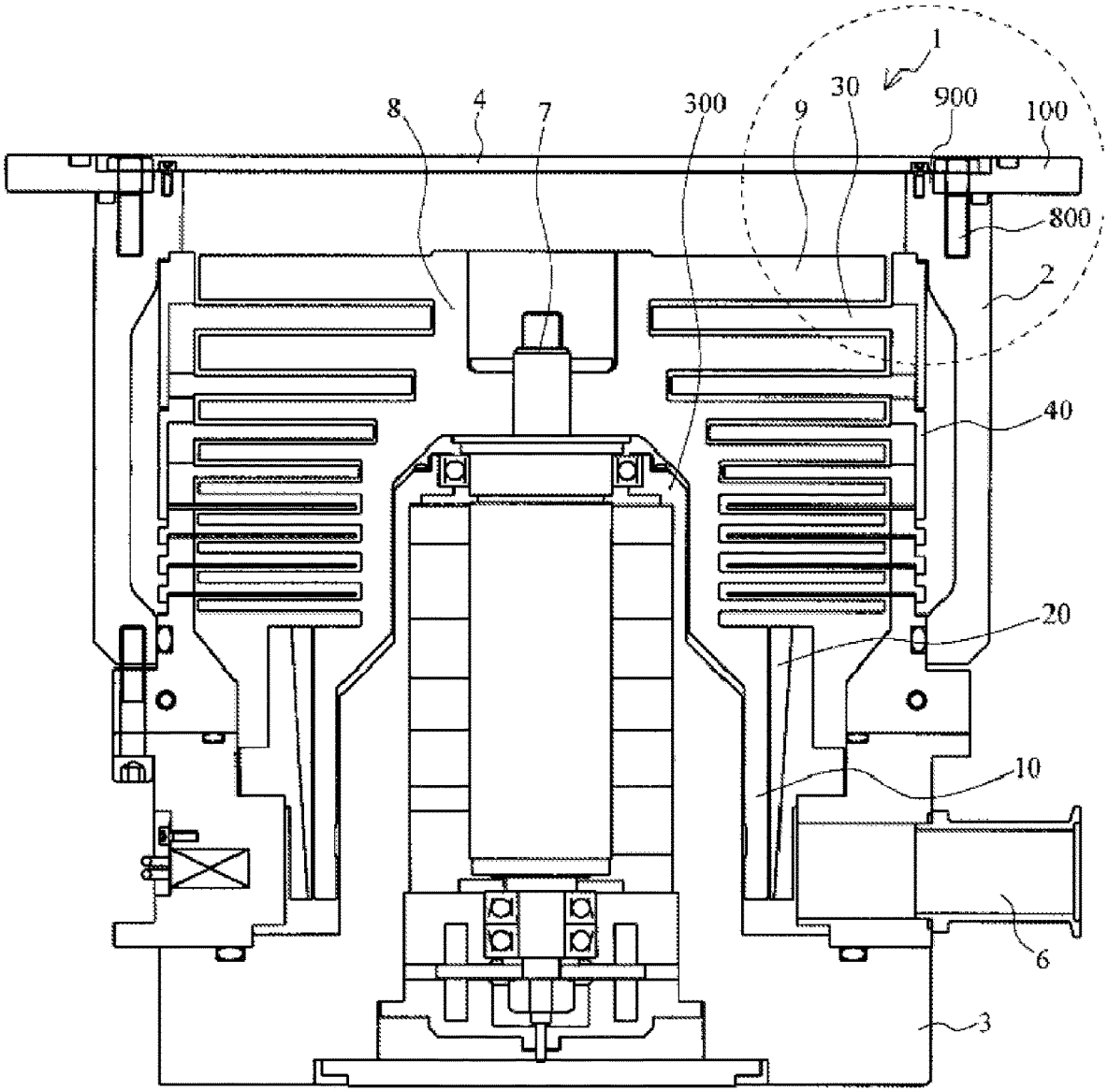
FIG. 1 is a diagram showing a schematic configuration example of a vacuum pump according to an embodiment of the present invention.

FIG. 1 is a diagram showing a schematic configuration example of the vacuum pump 1 according to the embodiment of the present invention and represents a sectional view in an axis direction of the vacuum pump 1.

In the embodiment of the present invention, for the sake of convenience, a diameter direction of a rotor blade will be described as a "radial (diameter or radius) direction" and a direction perpendicular to the diameter direction of the rotor blade will be described as an "axis direction (or an axial direction)", The casing (outer cylinder) 2 that forms a housing of the vacuum pump 1 has an approximately cylindrical shape and, together with a base 3 provided in a lower part (a side of an outlet port 6) of the casing 2, constitutes a chassis of the vacuum pump 1. In addition, a gas transferring mechanism which is a structure that enables the vacuum pump 1 to exhibit an exhaust function is housed inside the chassis.

Figure 2:
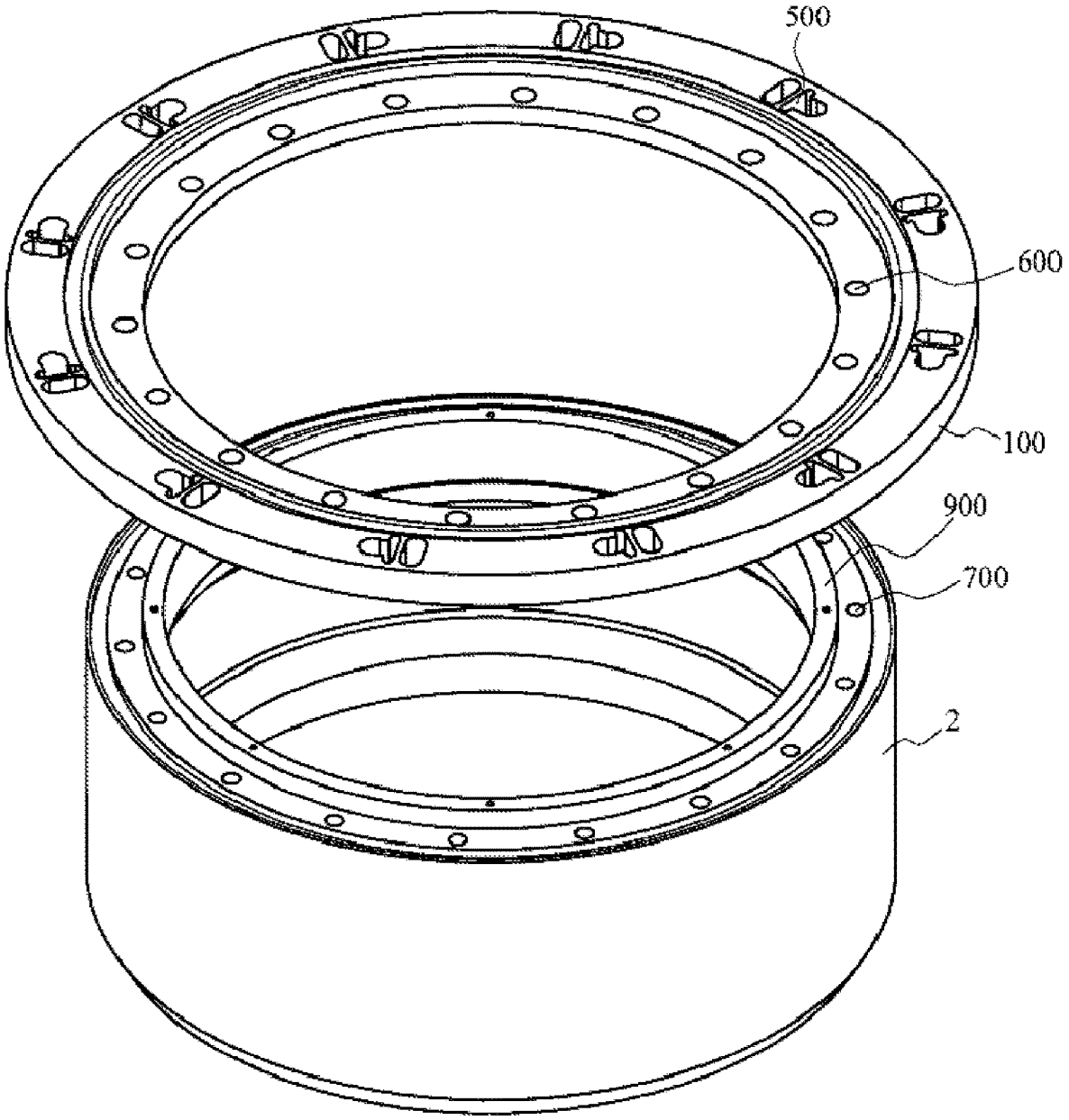
FIG. 2 is a diagram for describing an embodiment in which art inlet port flange and a casing (outer cylinder) are separately constructed.

As shown in FIG. 2, the casing (outer cylinder) 2 is constructed as a separate component from the inlet port flange 100. A material thereof is aluminum.

In the present embodiment, the gas transferring mechanism is made up of a rotatably-supported rotating body (rotor blades 9, a rotor cylindrical portion 10, and the like) and a stator portion (stator blades 30, a thread groove exhaust element 20, and the like) that is fixed to the chassis.

In addition, although not illustrated, a control apparatus that controls an operation of the vacuum pump 1 is connected via a dedicated line to an outer part of the housing of the vacuum pump 1.

Art inlet port 4 for introducing a gas into the vacuum pump 1 is formed in an end portion of the casing (outer cylinder) 2. In addition, the inlet port flange 100 which overhangs toward an outer peripheral side is formed on an end surface of the casing (outer cylinder) 2 on a side of the inlet port 4.

As shown in FIG. 2, the inlet port flange 100 is constructed as a separate component from the casing (outer cylinder) 2. A material thereof is stainless steel.

In addition, an outlet port 6 for exhausting a gas from the vacuum pump 1 is formed on a downstream side of the vacuum pump 1.

The rotating body includes a shaft 7 that is a rotating shaft, a rotor 8 arranged on the shaft 7, a plurality of rotor blades 9 provided on the rotor 8, and the rotor cylindrical portion (skirt portion) 10 provided on a side of the outlet port 6.

Each rotor blade 9 is constituted by a member extending vertically and radially with respect to an axis direction of the shaft 7.

In addition, the rotor cylindrical portion 10 is constituted by a cylindrical member having a cylindrical shape that is concentric with an axis of rotation of the rotor 8.

Although details are not illustrated, a motor portion for rotating the shaft 7 at high speed is provided midway along the axis direction of the shaft 7 inside a stator column 300. In addition, a radial direction magnetic bearing apparatus for supporting the shaft 7 in a radial direction in a contactless manner is provided on a side of the inlet port 4 and a side of the outlet port 6 with respect to the motor portion. Furthermore, an axial direction magnetic bearing apparatus for supporting the shaft 7 in an axial direction in a contactless manner is provided at a lower end of the shaft 7.

The stator blades 30 are formed on an inner peripheral side of the chassis. In addition, the stator blades 30 are fixed while being separated from each other by stator blade spacers 40 having a cylindrical shape.

It should be noted that, while the rotor blades 9 and the stator blades 30 are alternately arranged and formed in a plurality of steps in the axis direction, arbitrary numbers of rotor components and stator components can be provided as necessary in order to satisfy an exhaust performance that is required of the vacuum pump 1.

In the vacuum pump 1 according to the present embodiment, the thread groove exhaust element 20 (a thread groove-type exhaust element) is arranged on a side of the outlet port 6. A thread groove (spiral groove) is formed on a surface opposing the rotor cylindrical portion 10 of the thread groove exhaust element 20. Alternatively, a configuration may be adopted in which a thread groove is formed on a surface opposing the thread groove exhaust element 20 of the rotor cylindrical portion 10.

A side of the surface opposing the rotor cylindrical portion 10 of the thread groove exhaust element 20 (in other words, an inner peripheral surface that is parallel to the axis of the vacuum pump 1) opposes an outer peripheral surface of the rotor cylindrical portion 10 across a predetermined clearance and, when the rotor cylindrical portion 10 rotates at high speed, gas compressed by the vacuum pump 1 is sent to the side of the outlet port 6 while being guided by the thread groove in accordance with the rotation of the rotor cylindrical portion 10. In other words, the thread groove constitutes a flow path that transfers gas.

By having the surface opposing the rotor cylindrical portion 10 of the thread groove exhaust element 20 and the rotor cylindrical portion 10 oppose each other across the predetermined clearance as described above, a gas transferring mechanism is constructed which transfers gas with the thread groove formed on the inner peripheral surface on the axis direction-side of the thread groove exhaust element 20.

In order to reduce a force that causes a backflow of gas to the side of the inlet port 4, the smaller the clearance, the better.

In addition, a direction of the spiral groove formed on the thread groove exhaust element 20 is a direction toward the outlet port 6 when gas is transferred in the spiral groove in a rotation direction of the rotor 8.

Furthermore, a depth of the spiral groove gradually becomes shallower as the spiral groove approaches the outlet port 6, and gas transferred along the spiral groove is gradually compressed as the gas approaches the outlet port 6.

According to the configuration described above, the vacuum pump 1 is capable of performing vacuum exhaust processing inside an apparatus in which the vacuum pump 1 is fixed (arranged).

First Embodiment

FIG. 2 is a diagram for describing a configuration in which the inlet port flange 100 and the casing (outer cylinder) 2 are separated from each other and constructed as two components.

The inlet port flange 100 is made of stainless steel, and a bolt hole 600 through which a fastening bolt 800 (refer to FIG. 1) to be used to fasten the inlet port flange 100 to the casing (outer cylinder) 2 is to be passed is provided in plurality inside the inlet port flange 100. On the other hand, a bolt hole 500 to be used when fastening the vacuum pump 1 to a vacuum apparatus is provided in plurality on an outer side of the bolt holes 600. The vacuum apparatus and the vacuum pump 1 are fastened to each other by bolts via the bolt holes 500.

The bolt holes 500 have a special shape that enables the bolt holes 500 to function as a buffer structure for appropriately suppressing stress concentration when the vacuum pump 1 is subjected to an impact. Since the buffer structure is preferably formed of a material that is strong as possible, the inlet port flange 100 is formed of stainless steel.

On the other hand, the casing (outer cylinder) 2 is made of aluminum and provided with a plurality of bolt holes 700 through which the fastening bolt 800 (refer to FIG. 1) to be used to fasten the casing (outer cylinder) 2 to the inlet port flange 100 is to be passed. The bolt holes 600 of the inlet port flange 100 and the bolt holes 700 of the casing (outer cylinder) 2 are respectively provided at corresponding positions.

In addition, a projecting portion 900 to be used to perform positioning when fastening the casing (outer cylinder) 2 to the inlet port flange is provided across an entire periphery of the casing (outer cylinder) 2. Details of the projecting portion 900 will be given in the description of a second embodiment to be provided later.

Since strength is required of the casing (outer cylinder) 2, aluminum materials with alloy designations 2014 and 2017 in the JIS standard are preferably used.

In addition, since the casing (outer cylinder) 2 may be used in a corrosive gas environment, the inside of the casing (outer cylinder) 2 is preferably subjected to an electroless Nip plating treatment.

The inlet port flange 100 and the casing (outer cylinder) 2 are fastened to each other by the fastening bolts 800 via the respective bolt holes 600 and 700. In order to maintain a vacuum property between the inlet port flange 100 and the casing (outer cylinder) 2, airtightness is retained by an O-ring seal.

According to the present embodiment, by making the casing (outer cylinder) 2 with aluminum, weight can be reduced to approximately ⅓ and assembly work of the vacuum pump 1 can be made easier.

In addition, making the casing (outer cylinder) 2 with aluminum also enables weight of the entire vacuum pump 1 to be reduced by approximately 15% and makes installation work of the vacuum pump at an installation side easier.

Furthermore, making the casing (outer cylinder) 2 with aluminum also enables manufacturing cost of the vacuum pump 1 to be reduced by approximately 10%.

Moreover, since the casing (outer cylinder) 2 and the inlet port flange 100 are constructed as separate components, a machining operation is no longer required and cost can also be reduced from this perspective.

Second Embodiment

Figure 3:
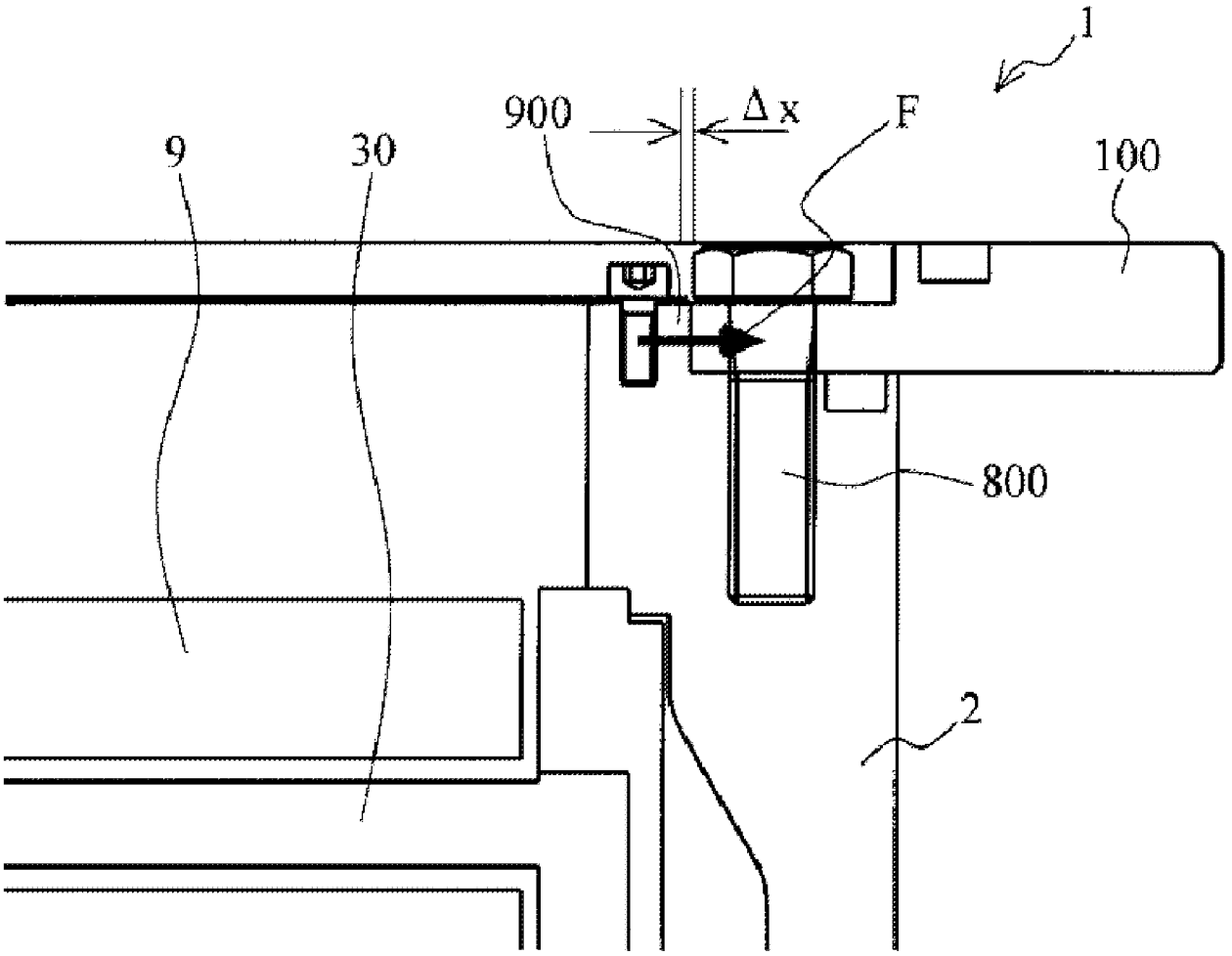
FIG. 3 is a partial enlarged view of FIG. 1 for describing a projecting portion.

In a second embodiment, the projecting portion 900 is provided across an entire periphery of the casing (outer cylinder) 2 on the assumption of the first embodiment that the casing (outer cylinder) 2 and the inlet port flange 100 are to be constructed as separate components. In addition, when fastening the casing (outer cylinder) 2 and the inlet port flange 100 to each other, the projecting portion 900 is engaged with the inlet port flange 100 to perform positioning in a radius direction. A relationship of positioning between the two components is shown in FIG. 3 which is a partial enlarged view of FIG. 1 (a portion enclosed by a dotted line).

Desirably, a gap between the two components in the radius direction is as small as possible.

Furthermore, adopting such a structure realizes a structure which deters impact from acting on the inlet port flange 100 and the fastening bolts 800 even when fracture energy is generated in the vacuum pump 1.

Specifically, since the structure causes impact acting on the casing 2 due to the fracture energy to act on the inlet port flange 100 through the projecting portion 900, when the impact is transferred to the inlet port flange 100, the projecting portion 900 deforms and consumes the fracture energy.

In addition, since the structure deters impact from being directly transferred to the fastening bolts 800 as compared to a case where the projecting portion 900 is not provided, breakage of the fastening bolts 800 can be prevented.

Furthermore, while there is a risk that fracture energy may be directly transferred to the inlet port flange 100 and the fastening bolts 800 when adopting a structure in which the projecting portion 900 protrudes farther than the inlet port flange 100 instead of the structure in which the projecting portion 900 protrudes toward a side of the inlet port flange 100 from the casing 2 as described above, this problem has been solved.

Modifications of Second Embodiment

Next, a modification of the second embodiment will be described with reference to FIGS. 4 and 5.

Figure 4:
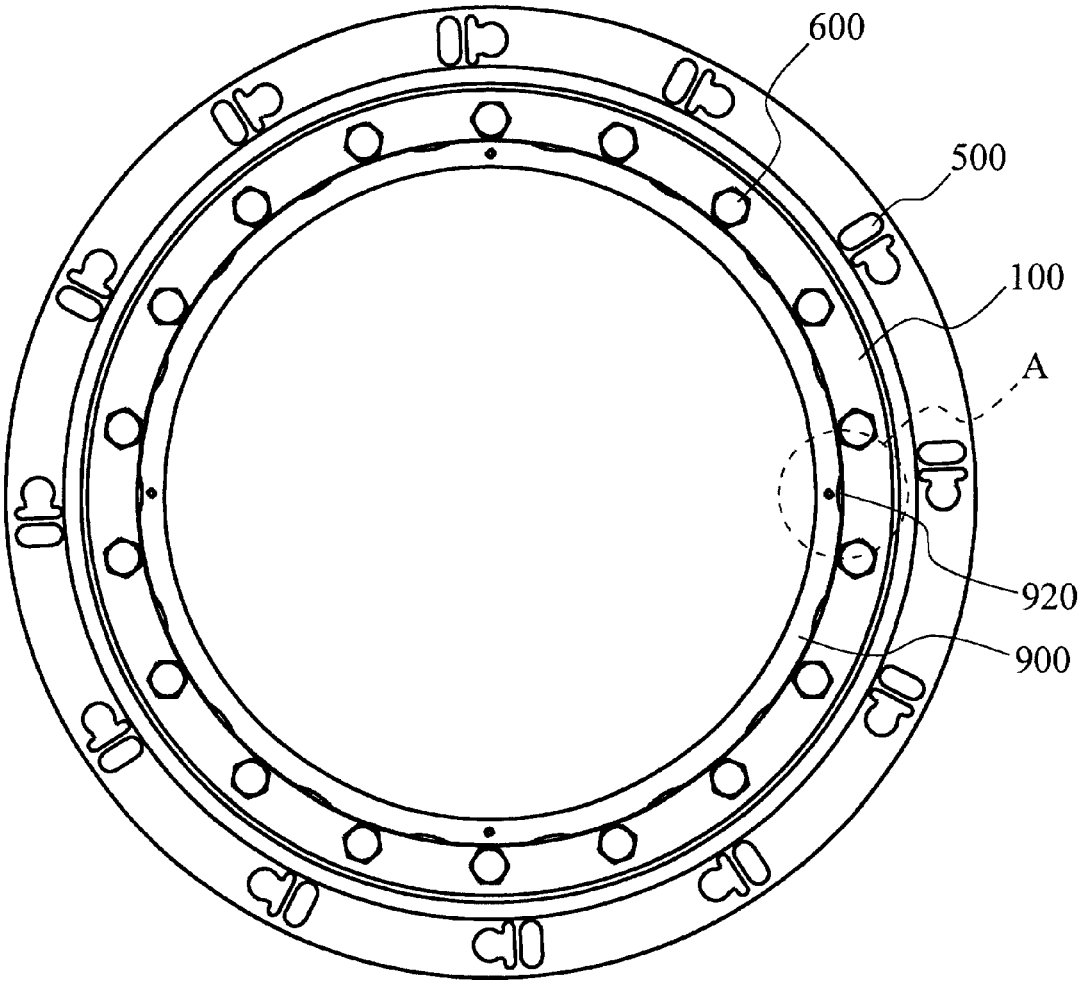
FIG. 4 is a diagram for describing a release portion provided in the projecting portion.

FIG. 4 shows an example in which a plurality of (18) bow-shaped release portions 920 are provided on a surface of the projecting portion 900 that comes into contact with the inlet port flange 100 (denoted by Δx in FIG. 3). The release portions 920 are arranged at regular intervals in a peripheral direction of the projecting portion 900. FIG. 5 is a partial enlarged view of FIG. 4.

Due to the release portions 920, a certain amount of fracture energy (F, refer to FIG. 3) received by the projecting portion 900 is absorbed. Specifically, by partially increasing a clearance between the projecting portion 900 and the inlet port flange 100, an amount of deformation (distortion) of the projecting portion 900 is enlarged to increase energy absorption efficiency of the projecting portion 900 due to plastic deformation and elastic deformation thereof.

Adopting such a structure in which gaps are partially provided in the peripheral direction enables positioning in the radius direction to be performed, reduces impact to the inlet port flange 100 as compared to a structure without the gaps, and prevents breakage of the fastening bolts 800.

Figure 5:
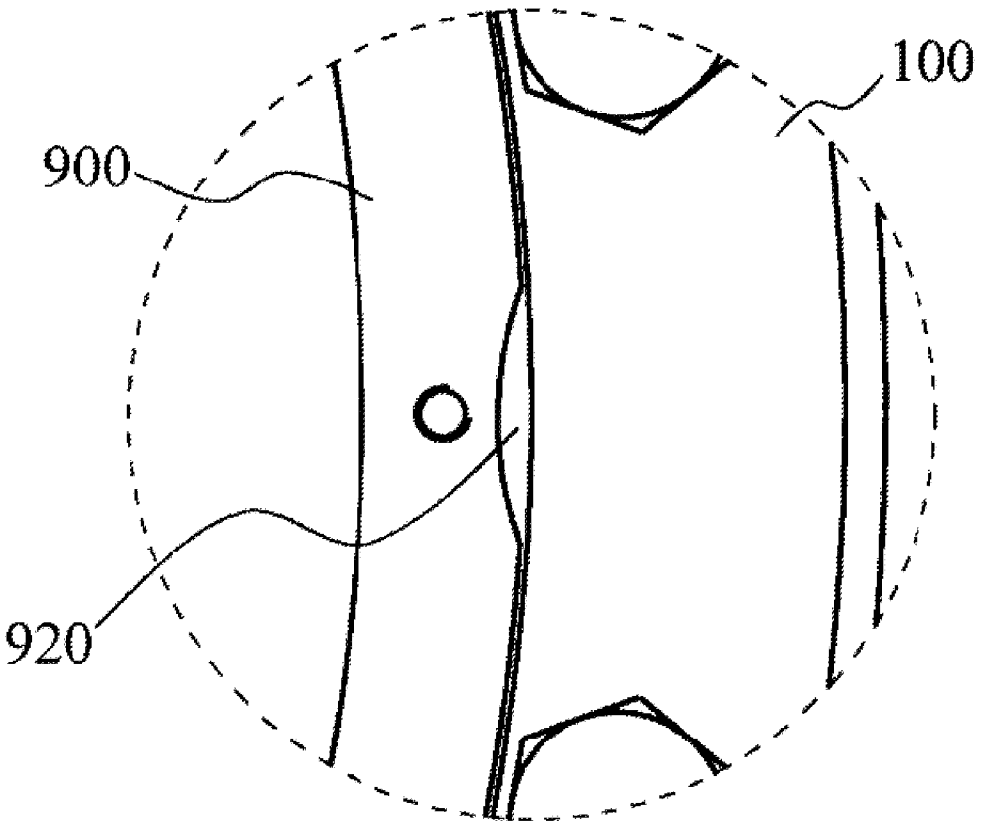
FIG. 5 is a partial enlarged view of the release portion shown in FIG. 4.

Although the release portions 920 shown in FIGS. 4 and 5 have bow shapes, alternatively, other shapes such as a C-shape that enable energy to be absorbed by the plastic deformation and the elastic deformation of the projecting portion 900 may be adopted.

Figure 6:
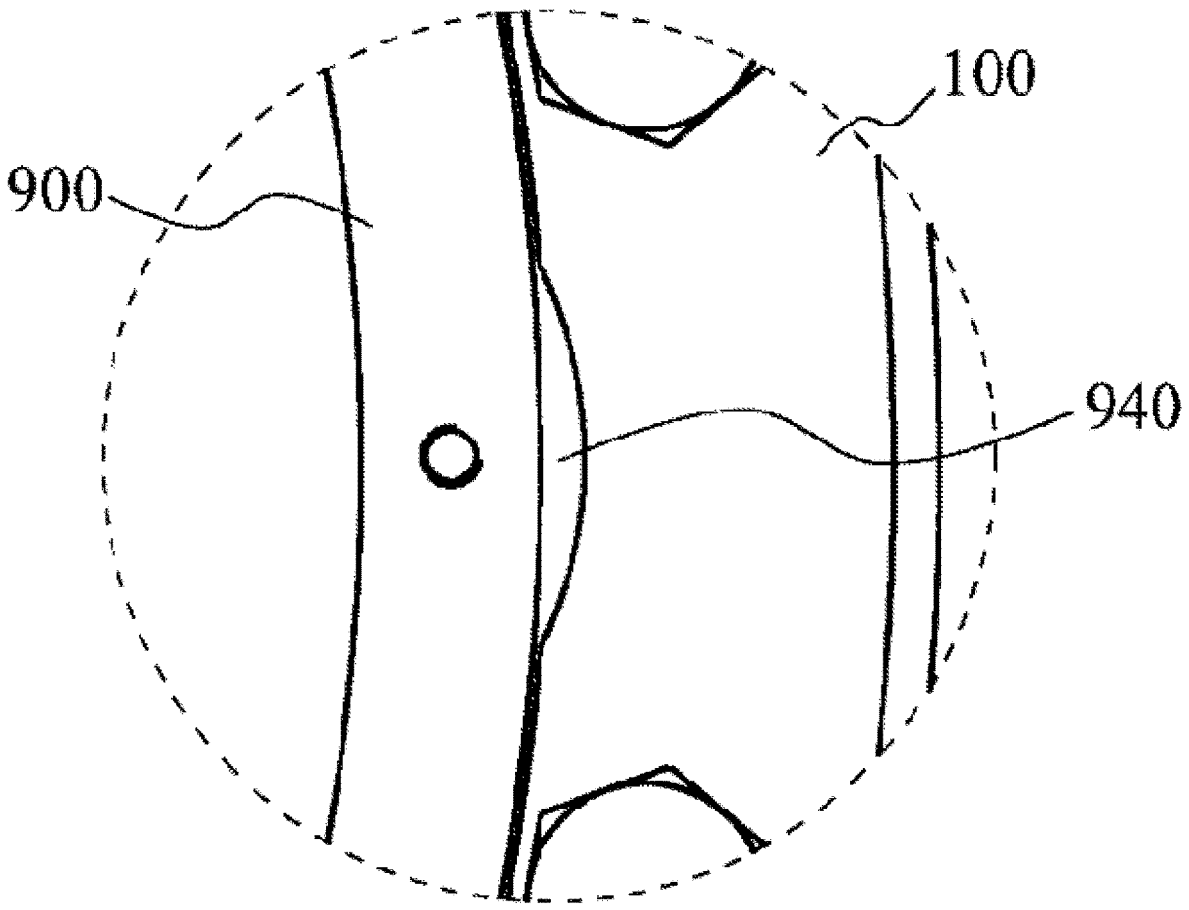
FIG. 6 is a diagram for describing a modification in which the release portion is provided on a side of an inlet port flange.
Figure 7:
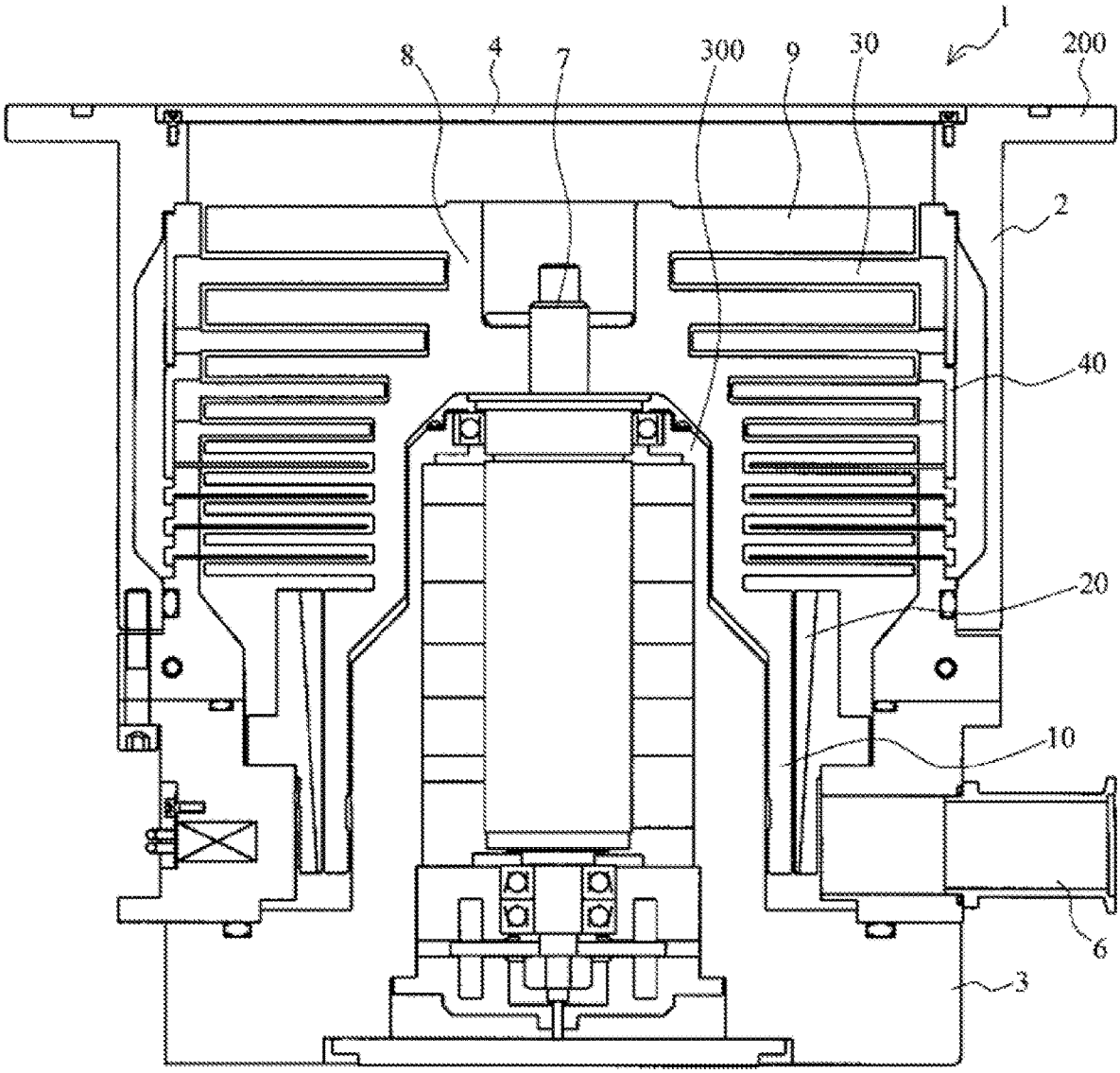
FIG. 7 (PRIOR ART)
FIG. 7 is a diagram for describing a vacuum pump according to conventional art.

Next, another modification of the second embodiment will be described with reference to FIG. 6.

In this modification, a release portion is provided on a side of the inlet port flange 100 (an inlet port flange-side release portion 940).

Even when providing the inlet port flange-side release portion 940 on the side of the inlet port flange 100 as in the present modification, a similar effect to the release portions 920 on the side of the projecting portion 900 shown in FIGS. 4 and 5 can be obtained.

In a similar manner to the release portions 920 on the side of the projecting portion 900, a shape of the inlet port flange-side release portion 940 is not limited to a bow shape and, for example, a C-shape may be adopted.

Various changes and modifications may be made to the present invention without departing from the spirit of the invention. Moreover, it will be obvious to those skilled in the art that the present invention also encompasses such changes and modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

an inlet port flange;

a casing which functions as a housing for covering internal members;

an outlet port;

a base portion; and a rotating portion which is enclosed by and rotatably supported by the casing and the base portion, wherein the inlet port flange and the casing are formed as separate components, the casing is made of aluminum, and the inlet port flange and the casing are fastened to each other at an inlet port of the casing using a plurality of fastening bolts such that the inlet port flange extends radially outward from an outer periphery of the casing such that respective heads of the fastening bolts are exposed to the inlet port and the pump is configured to be coupled to an apparatus at a portion of the inlet port flange that is radially outward of the outer periphery of the casing;

characterized in that a plurality of bolt holes for receiving the plurality of fastening bolts are provided radially inside of the outer periphery of the casing.

2. The vacuum pump according to claim 1, wherein the inlet port flange is made of stainless steel.

3. The vacuum pump according to claim 1, wherein the casing is provided with a projecting portion for performing positioning when fastening the casing to the inlet port flange.

4. The vacuum pump according to claim 3, wherein the projecting portion or the inlet port flange is provided with a release portion for absorbing fracture energy.

5. The vacuum pump according to claim 3, wherein the inlet port flange comprises a release portion for absorbing fracture energy between positions on the inlet port flange that come into contact with the projecting portion when fastening the inlet port flange to the casing.

* * * * *